US007640886B2

(12) United States Patent
Daodang et al.

(10) Patent No.: US 7,640,886 B2
(45) Date of Patent: Jan. 5, 2010

(54) DISK LUBRICANT TANK INSERT TO SUPPRESS LUBRICANT SURFACE WAVES

(75) Inventors: Hung Q. Daodang, Gardena, CA (US); Ferdinand Hendriks, Morgan Hill, CA (US); Larry W. Winterlin, San Jose, CA (US)

(73) Assignee: Hitachi Global Storage Technologies Netherlands B.V., Amsterdam (NL)

( * ) Notice: Subject to any disclaimer, the term of this patent is extended or adjusted under 35 U.S.C. 154(b) by 532 days.

(21) Appl. No.: 11/272,838

(22) Filed: Nov. 12, 2005

(65) Prior Publication Data

US 2006/0062957 A1 Mar. 23, 2006

(51) Int. Cl.
*B05C 3/00* (2006.01)

(52) U.S. Cl. ..... 118/423; 118/429

(58) Field of Classification Search ..... 118/429, 118/423; 134/902

See application file for complete search history.

(56) References Cited

U.S. PATENT DOCUMENTS

| | | | | |
|---|---|---|---|---|
| 3,979,531 | A | 9/1976 | Heller | 427/185 |
| 5,441,429 | A * | 8/1995 | Seidler | 439/876 |
| 5,601,122 | A * | 2/1997 | Beauchesne | 140/106 |
| 5,725,667 | A | 3/1998 | Petropoulos et al. | 118/407 |
| 2002/0110636 | A1 * | 8/2002 | Tombs et al. | 427/96 |
| 2002/0132043 | A1 | 9/2002 | Cromwell et al. | 427/127 |
| 2002/0187264 | A1 * | 12/2002 | Mallon et al. | 427/282 |

FOREIGN PATENT DOCUMENTS

| | | |
|---|---|---|
| JP | 57094932 | 6/1982 |
| JP | 61-40173 U | 3/1986 |
| JP | 63304426 | 12/1988 |
| JP | 1134721 | 5/1989 |
| JP | 1162227 | 6/1989 |
| JP | 1180274 | 7/1989 |
| JP | 2156418 | 6/1990 |
| JP | 2261568 | 10/1990 |
| JP | 3080430 | 4/1991 |
| JP | 5028471 | 2/1993 |
| JP | 05028471 | 2/1993 |
| JP | 6150307 | 5/1994 |
| JP | 6195704 | 7/1994 |
| JP | 9231561 | 9/1997 |
| JP | 2000000512 | 1/2000 |
| WO | WO 02/093566 A1 | 11/2002 |

* cited by examiner

*Primary Examiner*—Brenda A Lamb
(74) *Attorney, Agent, or Firm*—Zilka-Kotab, PC

(57) ABSTRACT

The disk lubricant tank of the present invention includes a lubricant bath cover device that resides on the lubricant bath surface to suppress surface waves. The bath cover includes a plurality of finger-like projecting members that define a plurality of disk passage slots therebetween. A plurality of disks are disposed upon a disk holding mandrel and are lowered into the lubricant bath. Each disk passes through a separate disk passage slot during the dipping process. The finger-like projections reside on the bath surface between the disk to suppress surface waves that would otherwise impinge upon side surfaces of the disk, leading to lubricant overcoat areas upon the side surfaces of the disk. Therefore, hard disks of the present invention are formed with a more uniform lubricant coating wherein unwanted lubricant overcoat areas formed by surface waves in the lubricant bath are suppressed.

9 Claims, 3 Drawing Sheets

DISK LUBRICANT TANK INSERT TO SUPPRESS LUBRICANT SURFACE WAVES

BACKGROUND OF THE INVENTION

1. Field of the Invention

The present invention relates generally to lubricant coatings for hard disks for hard disk drives, and more particularly to devices and methods to suppress surface waves in a disk lubricant dipping tank.

2. Description of the Prior Art

Hard disks that are utilized in hard disk drives are typically coated with a thin lubrication film to protect the surface of the disk during usage. A common method for applying the lubrication film to the disks is by use of a lubrication tank in which the disks are submerged in a lubricant bath and slowly withdrawn from the bath. It is desirable that the thin lubrication film form a single uniform film coating on the surface of the disk for optimum disk drive performance at the disk magnetic head interface. However, it has been found that unwanted variations in the thickness of the thin lubricant film are typically created when the lubricant film is applied utilizing the disk dipping tank method.

A reason for the creation of unwanted multiple layers of lubricant upon portions of the disk surface is the existence of small surface waves within the lubricant bath as the disks are removed from the bath. These surface waves cause the meniscus at the intersection of the disk surface with the lubricant bath surface to rise and fall. With each such rising and falling of the meniscus a thickened lubricant line is applied to the surface of the disk. The lubricant is dispersed in a highly volatile carrier fluid which rapidly evaporates from the surface of the disk, such that the thickened lubricant line from the surface wave remains upon the disk surface.

The present invention provides a solution to this problem by minimizing the surface waves of the lubricant bath to create a more uniform lubricant coating upon the disk surface.

SUMMARY OF THE INVENTION

The disk lubricant tank of the present invention includes a lubricant bath cover device that resides on the lubricant bath surface to suppress surface waves. The bath cover includes a plurality of finger-like projecting members that define a plurality of disk passage slots therebetween. A plurality of disks are disposed upon a disk holding mandrel and are lowered into the lubricant bath. Each disk passes through a separate disk passage slot during the dipping process. The finger-like projections reside on the bath surface between the disk to suppress surface waves that would otherwise impinge upon side surfaces of the disk, leading to unwanted lubricant overcoat areas upon the side surfaces of the disk. Therefore, hard disks of the present invention are formed with a more uniform lubricant coating wherein unwanted lubricant overcoat areas formed by surface waves in the lubricant bath are suppressed.

It is an advantage of the disk lubricant bath device of the present invention that hard disks are manufactured with a more uniform lubricant coating.

It is another advantage of the lubricant bath device of the present invention that surface waves within the lubricant bath are suppressed.

It is a further advantage of the lubricant bath device of the present invention that a bath cover device is provided which floats on the surface of the lubricant bath to adjust to differing lubricant bath levels.

It is an advantage of a hard disk of the present invention that it is manufactured with a more uniform lubricant coating.

These and other features and advantages of the present invention will no doubt become apparent to those skilled in the art upon reading the following detailed description which makes reference to the several figures of the drawing.

IN THE DRAWINGS

The following drawings are not made to scale as an actual device, and are provided for illustration of the invention described herein.

DETAILED DESCRIPTION OF THE PREFERRED EMBODIMENTS

As is well known to those skilled in the art, hard disks for use in hard disk drives are coated with a thin lubrication film to protect the surface of the hard disk during hard disk drive operation. This protection is necessary where the magnetic head of the hard disk drive floats on an air bearing just a few microns above surface of the disk. Where the magnetic head, for various reasons, makes unwanted contact with the hard disk, the lubricant coating serves to minimize damage to both the hard disk surface and the surface of the magnetic head. The application upon the disk surface of a lubricant film having a uniform thickness is therefore desirable, particularly as the air bearing gap of more advanced hard disk drives is generally decreasing. However, as is next described, prior art lubricant film application techniques, specifically utilizing a lubricant tank into which the hard disks are dipped, results in a lubricant film having unwanted thickness variations. As is further described herebelow, the present invention seeks to eliminate the lubricant film thickness variations that have previously resulted from the use of a disk dipping lubrication tank.

Figure 1:
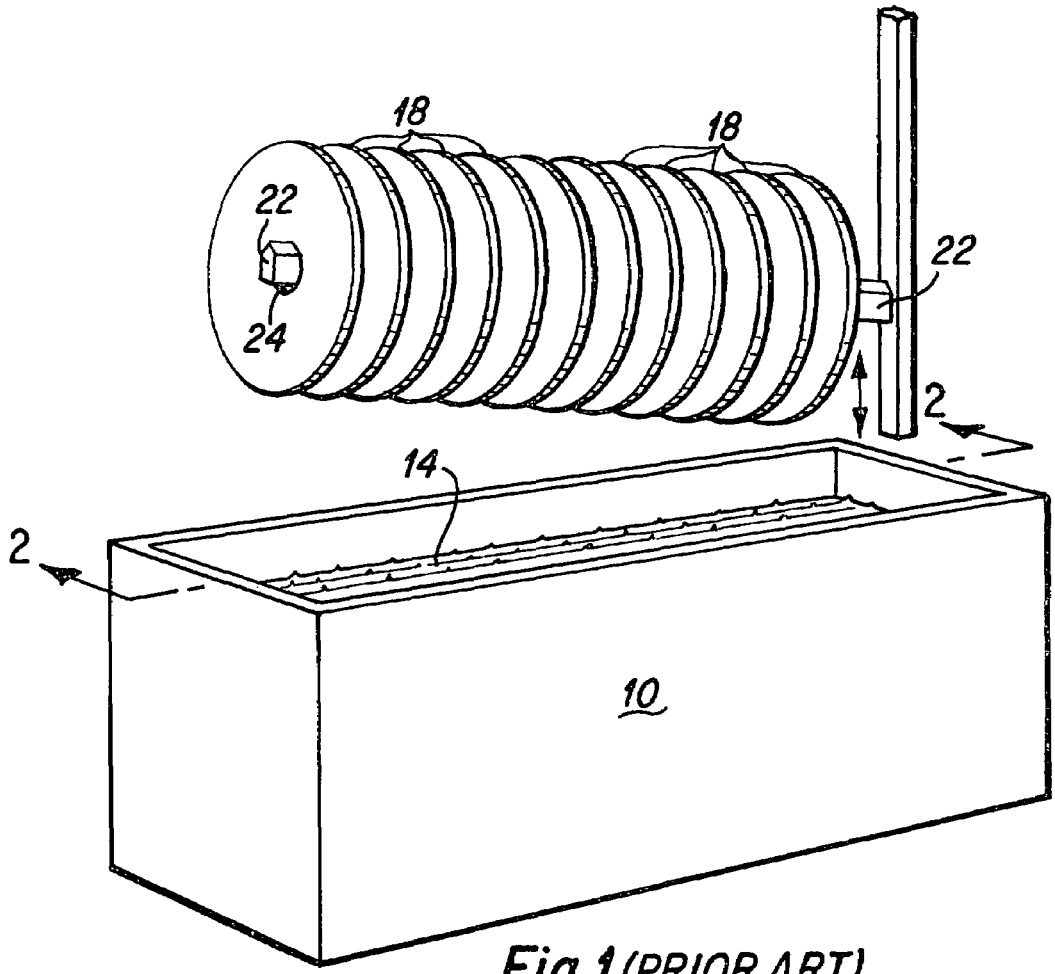
Fig.1 (PRIOR ART)
FIG. 1 is a perspective view of a prior art disk lubrication system.
Figure 2:
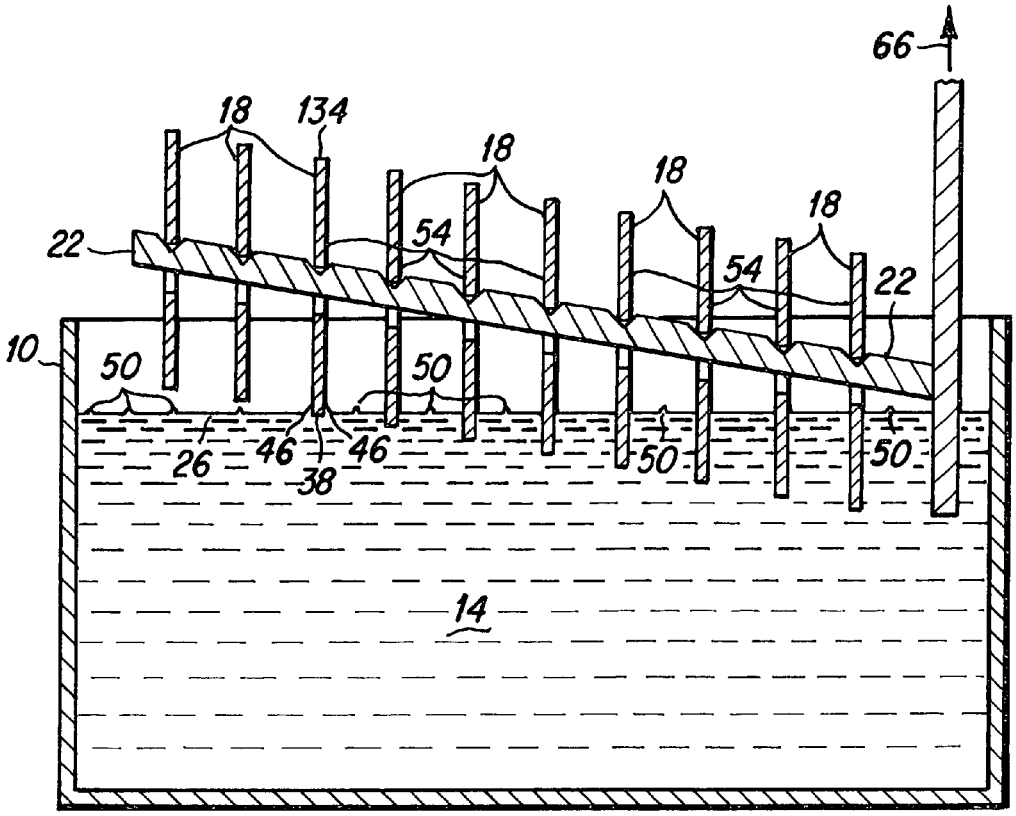
Fig.2 (PRIOR ART)
FIG. 2 is a side cross-sectional view of the prior art disk lubrication system depicted in FIG. 1.
Figure 3:
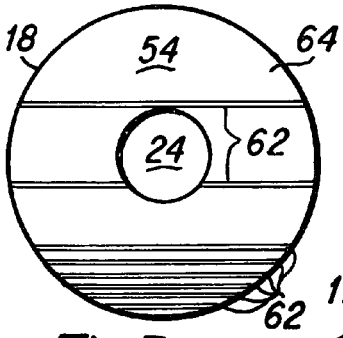
FIG. 3 is a front plan view of a prior art hard disk depicting an unwanted uneven lubrication layer, as applied utilizing the prior art lubrication tank dipping process.

FIG. 1 is a perspective view of a typical prior art lubrication tank for the dipping of hard disks therewithin, FIG. 2 is a cross-sectional view of the disk lubrication tank depicted in FIG. 1, taken along lines 2-2 of FIG. 1, and FIG. 3 is a front plan view of a prior art hard disk where the variations in lubricant thickness are depicted as horizontal lines. As depicted in FIG. 1, a typical disk lubrication tank 10 is a generally rectangular walled container that is typically formed of stainless steel. A lubricant bath 14 is disposed within the tank 10, and the bath liquid is typically composed of the disk lubricant dissolved in a highly volatile carrier fluid. The disks 18 to be dipped into the bath 14 are oriented vertically upon a notched mandrel 22 that projects through the central opening 24 of each disk. The mandrel 22 is lowered into the bath 14, such that the disks 18 are all submerged in the bath 14, and then raised to remove all of the now lubricant solution coated disks from the bath. The volatile carrier fluid rapidly evaporates, leaving a thin lubricant film on the surfaces of the disk 18.

Focusing next on the cross-sectional view of FIG. 2, a plurality of disks 18 are shown emerging from the lubricant bath 14. It is to be understood that all of the disks 18 have been previously fully submerged into the lubricant bath 14 and are depicted at a point during the raising of the mandrel 22 with the disks 18 mounted thereon. Initially, it is seen that the mandrel is disposed at an angle with respect to the surface 26 of the lubricant bath 14. As a result, each of the individual disks 18 emerges from the surface 26 of the bath at a separate time. A particular depiction of the problem created by capillary surface waves is shown with regard to disk 34 which is depicted in the instant before the bottom edge 38 of the disk 34 is removed from the lubricant bath 14. As can be seen, due to the capillary effect between the liquid and the disk, a small portion 46 of the liquid meniscus is drawn upwardly from the nominal surface 26 of the bath in continued contact with the bottom edge 38 of the disk 34. A moment later (not depicted), as the mandrel 22 rises further in removing the disks 18 from the bath, the upraised portions 46 of the lubricant meniscus will release from the bottom edge 38 of the disk 34 and fall back into the bath 14, thereby creating a small surface waves 50, termed capillary waves, across the surface 26 of the bath 14. These capillary waves 50 will strike the surfaces 54 of the disks that remain within the lubricant bath 14, and the small capillary surface waves 50 will create small additional lubricant coating areas as the lubricant meniscus of the waves 50 in contact with the disk surface 54 moves up and down. Immediately thereafter, the volatile carrier component of the lubricant bath evaporates from the surface 54 of the disk, leaving unwanted additional lubricant layer areas upon the surface 54 of the disk where the capillary wave 50 struck the disk 18. Because the surface of the lubricant bath generally strikes the surface 54 of the disk in a horizontal line 62, the unwanted lubricant overcoatings appear on the surface of the disk in horizontal lines, as is depicted in FIG. 3 and discussed herebelow. It is therefore to be understood that as each of the disks 18 emerges from the lubricant bath, capillary surface waves 50 are created which travel across the surface 26 of the bath and strike the disk surfaces 54 of remaining disks to create unwanted layerings of lubricant 62 upon the remaining disks, leading to an uneven lubricant coating upon the surface 54 of the disk 18.

FIG. 3 depicts a prior art hard disk 64 having an uneven lubricant coating as a result of unwanted surface waves within the lubricant tank. Particularly, the uneven lubricant coating areas are shown as horizontal lines 62 across the surface 54 of the disk 64, which correspond to multiple thicknesses of lubricant that were deposited by surface waves 50 as the disk 64 was removed in the vertical direction (arrow 66) from the lubricant bath.

In general terms, the present invention includes a device which acts as a surface wave barrier that is disposed at the surface of the lubricant tank between adjacent disks to interrupt surface waves. A perspective view of a surface wave interrupting device 100 of the present invention is depicted in FIG. 4, and a cross-sectional view of the surface wave interrupting device 100 as disposed within a disk lubricant tank 10 is depicted in FIG. 5; a hard disk 110 of the present invention with a more uniform lubricant coating is depicted in FIG. 6.

Figure 4:
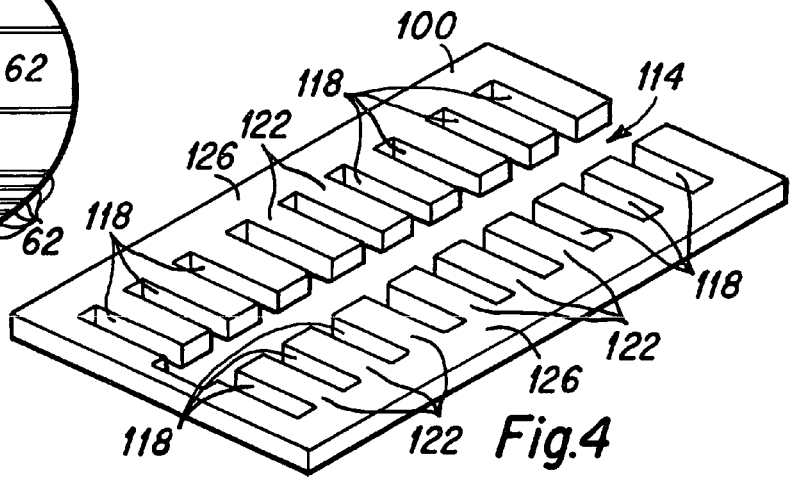
FIG. 4 is a perspective view of a lubrication tank insert of the present invention.

As depicted in FIG. 4, a surface wave interrupting device 100 of the present invention can take the form of a lubricant bath cover that is preferably though not necessarily designed to float on the surface 26 of the lubricant bath. The bath cover device is generally, though not necessarily, rectangular to substantially match the shape of the rectangular tank 10. The bath cover 100 is an integrally formed member including a central mandrel passage slot 114 for the passage of the mandrel 22 therethrough and a plurality of individual disk passage slots 118 for the passage of the individual disks 18 therethrough when the bath cover is disposed upon the surface 26 of the lubricant bath 14. The disk passage slots 118 are generally perpendicular to the central mandrel passage slot 114. The bath cover can therefore be thought of as having a plurality of finger-like projecting members 122 that project from the side portions 126 of the bath cover 100 into locations between adjacent pairs of hard disks.

Figure 5:
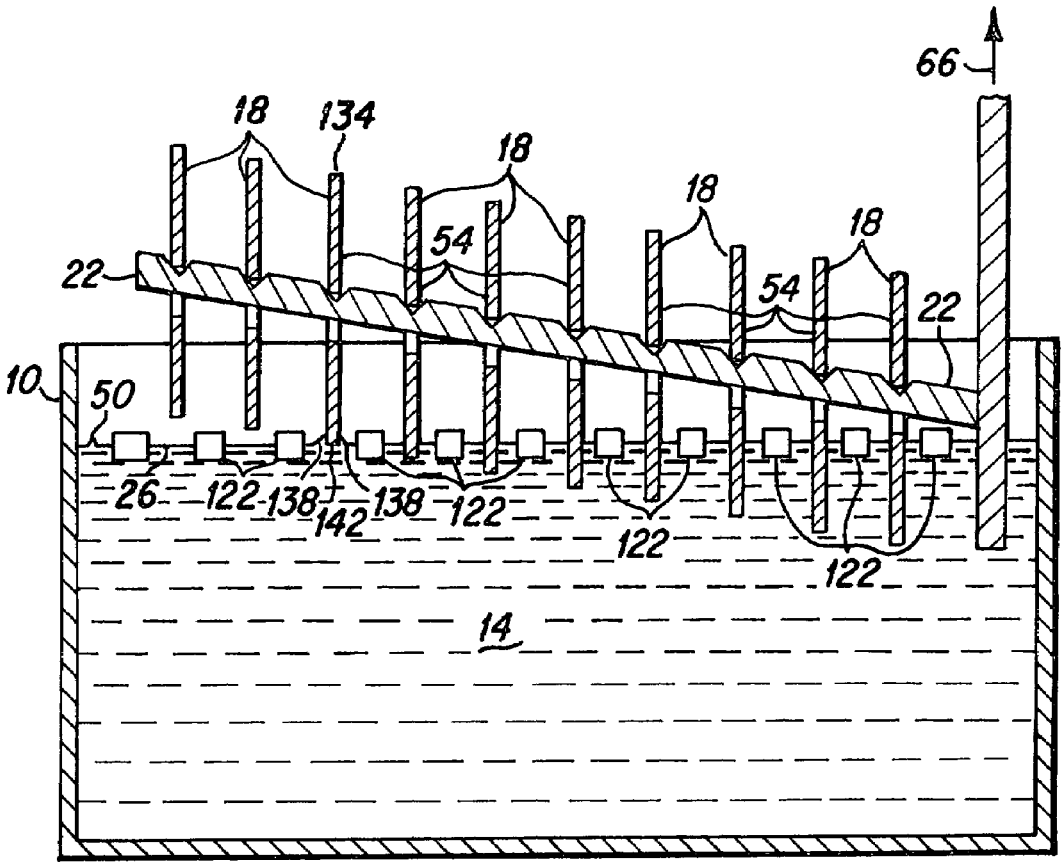
FIG. 5 is a side cross-sectional view of a lubrication tank of the present invention that includes the insert depicted in FIG. 4.
Figure 6:
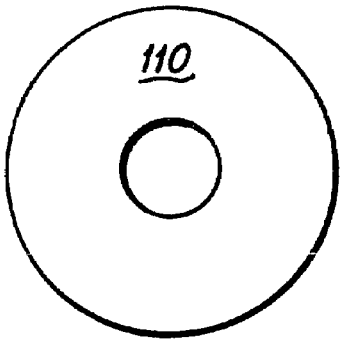
FIG. 6 is a front plan view of a hard disk having a lubrication layer obtained utilizing the lubrication tank depicted in FIG. 5.

Referring now to FIG. 5, it can be seen that the finger-like projecting members 122 of the bath cover that define the disk slots 118 are disposed upon the surface 26 of the lubricant bath 14 between each of two adjacent disks 18. A hard disk 134 is shown emerging from the surface 26 of the lubricant bath 14, such that the liquid capillary action draws the liquid meniscus 138 upward in contact with the bottom edge 142 of the disk 134. Thereafter, as the mandrel 22 is raised upwards (not shown), the bottom edge 142 of the disk breaks contact with the liquid 14 and the liquid meniscus 138 falls back to the surface 26 of the bath 14, and surface capillary waves will be created. However, the finger-like projections 122 of the bath cover act to intercept and suppress the surface waves, such that the waves cannot reach the adjacent disk 18, nor any of the other disks 18 that are still in contact with the lubricant bath 14. As a result, the surface waves created by each of the disks 18 as they emerge from the surface 26 of the lubricant bath 14 do not travel across the surface 26 of the lubricant bath to impinge upon the sides 54 of the disks 18 that remain within the bath. The bath cover 100 thus serves to suppress these surface waves, whereby disks 18 emerge from the lubricant bath without the uneven lubricant thickness horizontal lines 62 of the prior art disk 64. A hard disk 110 of the present invention is depicted in FIG. 6, in which the surface wave created lubricant thickness lines substantially do not exist. Thus the hard disks 110 of the present invention have a generally uniform thin film lubricant layer.

Figure 7:
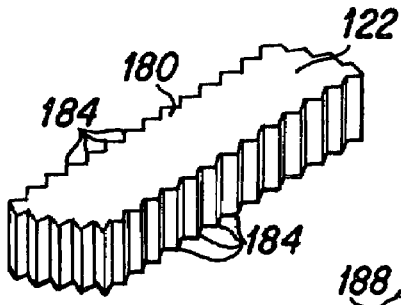
FIG. 7 is a perspective view of a finger-like projecting member of the present invention having an irregular outer surface.
Figure 8:
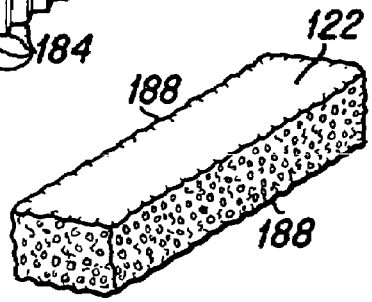
FIG. 8 is a perspective view of a finger-like projecting member of the present invention having a porous outer surface.

It is preferable that the bath cover 100 be comprised of a material that will not contaminate the lubricant nor form particulates that may become resident upon the disk surfaces. Suitable materials are stainless steel and Teflon, although the invention is not to be so limited. It is desirable that the bath cover 100 be held stationary within the tank such that the dipping of the disks is reliably conducted without the disks making solid-solid contact with the bath cover fingers 122 that are disposed between the disks 18. It is also desirable that the bath cover 100 be vibrationally isolated from the tank walls 10, such that external vibrations that are transmitted to the tank walls, are not transmitted to the bath cover. The bath cover 100 can then act to intercept surface waves from the tank walls 10 that might otherwise impinge upon the disk surfaces to create the unwanted multiple layering of lubricant upon the disk surfaces. The bath cover of the present invention may be further improved, as is depicted in FIG. 7, by modifying the edge surfaces of the finger-like projections 122 to be non-reflective of surface waves that may occur. Specifically, the edges 180 may be irregularly shaped 184 (rather than smooth and flat) and/or, as depicted in FIG. 8, they may be formed of a porous material 188 that is absorbent of surface waves that strike the porous surface 188, such that the surface waves are not reflected.

While the present invention has been shown and described with regard to certain preferred embodiments, it is to be understood that modifications in form and detail will no doubt be developed by those skilled in the art upon reviewing this disclosure. It is therefore intended that the following claims cover all such alterations and modifications that nevertheless include the true spirit and scope of the inventive features of the present invention.

We claim:

1. An apparatus for applying a lubrication layer onto hard disks, comprising:

a lubrication tank being adapted to hold a lubricant bath;

a disk holding means being adapted to hold a plurality of hard disks, each said hard disk being disposed at a corresponding location along a length of said disk holding means; and a plurality of projecting members, each said projecting member being disposed within said tank and adapted to be disposed between an adjacent pair of said plurality of hard disks, to interrupt a substantial portion of surface waves of said lubricant bath that travel between said adjacent pair of hard disks, wherein said plurality of projecting members are integrally formed within a bath cover that is disposed to position said projecting members at a surface of said lubricant bath, wherein said bath cover comprises a generally rectangular integrally formed member having a central mandrel passage slot formed therethrough and a plurality of disk passage slots formed therethrough generally perpendicularly to said mandrel passage slot.

2. An apparatus for applying a lubrication layer onto hard disks as described in claim 1 wherein said projecting members include side surfaces for making contact with said surface waves, and wherein said side surfaces are irregularly shaped to diminish reflection of said surface waves from said projecting members.

3. An apparatus for applying a lubrication layer onto hard disks, comprising:

a lubrication tank being adapted to hold a lubricant bath;

a disk holding means being adapted to hold a plurality of hard disks, each said hard disk being disposed at a corresponding location along a length of said disk holding means; and a plurality of projecting members, each said projecting member being disposed within said tank and adapted to be disposed between an adjacent pair of said plurality of hard disks, to interrupt a substantial portion of surface waves of said lubricant bath that travel between said adjacent pair of hard disks, wherein said plurality of projecting members are integrally formed within a bath cover that is disposed to position said projecting members at a surface of said lubricant bath, wherein said projecting members include side surfaces for making contact with said surface waves, and wherein said side surfaces are formed of a porous material to diminish reflection of said surface waves from said projecting members.

4. An apparatus for applying a lubrication layer onto hard disks as described in claim 3, wherein said side surfaces are also irregularly shaped to diminish reflection of said surface waves from said projecting members.

5. An apparatus for applying a lubrication layer onto hard disks, comprising:

a lubrication tank being adapted to hold a lubricant bath;

a disk holding portion being adapted to hold a plurality of hard disks, each said hard disk being disposed at a corresponding location along a length of said disk holding portion; and a plurality of projecting members, each said projecting member being disposed in said tank and adapted to be disposed between an adjacent pair of said plurality of hard disks, to interrupt at least some surface waves of said lubricant bath that travel between said adjacent pair of hard disks, wherein said plurality of projecting members are integrally formed within a bath cover that is disposed to position said projecting members at a surface of said lubricant bath, wherein said bath cover comprises a generally rectangular integrally formed member having a central mandrel passage slot formed therethrough and a plurality of disk passage slots formed therethrough generally perpendicularly to said mandrel passage slot.

6. An apparatus for applying a lubrication layer onto hard disks as described in claim 5, wherein said projecting members include side surfaces for making contact with said surface waves, and wherein said side surfaces are irregularly shaped to diminish reflection of said surface waves from said projecting members.

7. An apparatus for applying a lubrication layer onto hard disk, comprising a lubrication tank being adapted to hold a lubricant bath;

a disk holding portion being adapted to hold a plurality of hard disks, each said hard disk being disposed at a corresponding location along a length of said disk holding portion; and a plurality of projecting members, each said projecting member being disposed in said tank and adapted to be disposed between an adjacent pair of said plurality of hard disks, to interrupt at least some surface waves of said lubricant bath that travel between said adjacent pair of hard disks, wherein said projecting members include side surfaces for making contact with said surface waves, and wherein said side surfaces are formed of a porous material to diminish reflection of said surface waves from said projecting members.

8. An apparatus for applying a lubrication layer onto hard disks as described in claim 7, wherein each of said projecting members are disposed at the surface of said lubricant bath.

9. An apparatus for applying a lubrication layer onto hard disks as described in claim 7, wherein said projecting members include side surfaces for making contact with said surface waves, and wherein said side surfaces are irregularly shaped to diminish reflection of said surface waves from said projecting members.

* * * * *

UNITED STATES PATENT AND TRADEMARK OFFICE

CERTIFICATE OF CORRECTION

PATENT NO. : 7,640,886 B2
APPLICATION NO. : 11/272838
DATED : January 5, 2010
INVENTOR(S) : Daodang et al.

It is certified that error appears in the above-identified patent and that said Letters Patent is hereby corrected as shown below:

On Title Page: Insert item 63

--Related U.S. Application Data
Continuation of application No. 10/677,117, filed on September 30, 2003, now abandoned.--

In the Specification:

col. 1, line 4. Insert --Cross-Reference to Related Application
This application is a divisional application of copending U.S. Patent Application Serial No. 10/677,177 filed on September 30, 2003.--

Signed and Sealed this

Sixteenth Day of February, 2010

David J. Kappos

David J. Kappos
*Director of the United States Patent and Trademark Office*